United States Patent [19]

Tadros

[11] Patent Number: 4,883,541

[45] Date of Patent: Nov. 28, 1989

[54] NONCHROMATE DEOXIDIZER FOR ALUMINUM ALLOYS

[75] Inventor: Maher E. Tadros, Ellicott City, Md.

[73] Assignee: Martin Marietta Corporation, Bethesda, Md.

[21] Appl. No.: 297,829

[22] Filed: Jan. 17, 1989

[51] Int. Cl.[4] ..... B08B 3/08

[52] U.S. Cl. ..... 134/3; 134/41; 252/79.2; 252/79.5

[58] Field of Search ..... 134/3, 41; 252/79.2

[56] References Cited

U.S. PATENT DOCUMENTS

| | | | |
|---|---|---|---|
| Re. 25,789 | 6/1965 | Barnes | 252/79.2 |
| 2,564,549 | 8/1951 | Spargardter | 134/3 |
| 2,593,449 | 4/1952 | Hesch | 41/42 |
| 2,637,634 | 5/1953 | Howard et al. | 41/42 |
| 2,795,491 | 6/1957 | Newman et al. | 41/42 |
| 3,140,203 | 7/1964 | Grunwald | 134/3 |
| 3,275,562 | 9/1966 | Smith | 252/147 |
| 3,275,562 | 9/1966 | Smith | 252/79.3 |
| 3,448,055 | 6/1969 | Mickelson et al. | 252/79.3 |
| 3,510,430 | 5/1970 | Mickelson et al. | 252/79.3 |
| 3,565,771 | 2/1971 | Gulla | 252/79.2 |
| 3,634,262 | 1/1972 | Grunwald et al. | 252/100 |
| 3,647,698 | 3/1972 | Bellinger et al. | 252/79.4 |
| 3,957,553 | 5/1976 | Smith | 252/79.5 |
| 4,012,192 | 3/1977 | Doerr | 8/34 |
| 4,032,359 | 6/1977 | Fisher | 252/79.2 |
| 4,100,015 | 7/1978 | Russell | 156/665 |
| 4,124,407 | 11/1978 | Binns | 134/3 |
| 4,212,701 | 7/1980 | Russel | 252/79.2 |
| 4,230,522 | 10/1980 | Martin et al. | 156/638 |
| 4,346,128 | 8/1982 | Loch | 427/328 |
| 4,401,435 | 8/1983 | Davis et al. | 8/627 |
| 4,451,304 | 5/1984 | Batiuk | 148/268 |
| 4,614,607 | 9/1986 | Loch | 252/142 |
| 4,614,607 | 9/1986 | Loch | 252/142 |
| 4,728,456 | 3/1988 | Yamasoe | 252/142 |

*Primary Examiner*—Asok Pal
*Assistant Examiner*—O. Ojan
*Attorney, Agent, or Firm*—Herbert W. Mylius; Gay Chin

[57] ABSTRACT

Smut may be removed from the surface of aluminum or aluminum alloys by a deoxidizer comprising nitric acid, a halate salt, and, optionally, an activator.

55 Claims, No Drawings

NONCHROMATE DEOXIDIZER FOR ALUMINUM ALLOYS

FIELD OF THE INVENTION

The present invention relates to a composition for the removal of smut from aluminum or aluminum alloy surfaces.

DESCRIPTION OF THE PRIOR ART

This invention is related to the art of treating metal surfaces. More particularly, this invention relates to novel compositions and processes for treating the surfaces of aluminum and aluminum based alloys to condition and clean such surfaces for subsequent treatment. Aluminum and aluminum alloy metals are used in a variety of settings where they are subjected to wear and corrosion. After being cast or formed into desired shapes, aluminum surfaces usually receive protective coatings, such as layers of aluminum oxide, paint, or wax, to resist wear or corrosion. Before such protective coatings are applied, the metal is generally treated by degreasing, alkaline cleaning, rinsing, and deoxidizing the surface.

A deoxidized aluminum surface may be anodized to convert surface aluminum metal to corrosion resistant aluminum oxide. Alternatively, after deoxidation, an aluminum surface may be treated to form a mixed oxide layer containing various metal ions on the aluminum surface. Two commonly used solutions for surface protection are marketed under the trademarks ALADINE and IRIDITE, each of which contains chromic acid. After anodizing or conversion coating has been completed, a paint, wax, or other additional protective coating may be applied.

Corrosion resistance of aluminum is dependent, in part, on successfully deoxidizing the surface prior to conversion coating or anodizing. Successful deoxidizing requires a thoroughly clean surface, free from grease, coatings, or other impurities. In addition, the surface should be activated to improve the receptivity of the surface to subsequent protective coatings.

Deoxidation usually is achieved with chromated acid solutions, but these solutions are ineffective at removing smut, caused by caustic solutions. In particular, chromated deoxidizers have difficulty in removing smut on cast alloys or weld zones on aluminum weldments. Brushing has ordinarily been necessary to remove smut from the aluminum after deoxidizing. Chromated acid deoxidizing solutions are environmentally undesirable and because the Environmental Protection Agency has enacted regulations which restrict chromium effluents, chromium treatment plants are being installed at high cost at metal finishing facilities.

Nonchromated deoxidizing solutions are known, but they are typically less effective than the chromate deoxidizers. One nonchromated deoxidizing solution is described in U.S. Pat. No. 4,346,128, and includes a mixture of 50 volume percent $HNO_3$ (40°–42° Baume), 25 volume percent $H_2SO_4$ (66° Baume), 25 volume percent $H_2O$, and 1 lb/gal ammonium flouride.

Solutions containing fluorine compounds are also known for cleaning and etching aluminum, for example, as are described in U.S. Pat. No. 4,124,407, which discloses mixtures of HF and $H_2SO_4$ for cleaning with little or no etching, U.S. Pat. No. 3,634,262, which discloses perdiphosphate compound and a fluoride salt for preparing surfaces for anodizing, and U.S. Pat. No. 4,230,522, which discloses a mixture of phosphoric acid, nitric acid, acetic acid and a fluoroborate anion containing compound for etching thin films of aluminum. Etchants based on hydrofluoric acid or ammonium bifluoride have been used to produce a very white finish on sheet materials suitable for nameplate applications.

One of the ways for preparing the surface of aluminum for further processing is to etch the surface in an alkali or acid solution, to remove oils adhering to the surface of the aluminum, oxidation film which cannot be removed by degreasing, scales, stains penetrating into the aluminum, to smooth a surface-dressed aluminum, to deluster the surface of the aluminum, or to make the surface uniform.

However, etching of an aluminum surface using such solutions, particularly alkaline etchants, leads to the formation of areas of a black, insoluble residue, or smut, on the surface. The composition of the smut varies with the alloy, but generally is composed of the oxides of alloying metals, particularly copper. The smut dulls the metal surface, and if not removed, when a plating film or a coating film is formed thereupon only poor adherence results.

Various compositions have been utilized to remove this smut, an operation known in the industry as "desmutting", and also encompassed within the term "deoxidizing."

Typical methods employed in the past by which smut has been removed from alloy surfaces include immersing the previously treated aluminum object in a solution containing oxidizing agents such as chromic acid, chromates, or dichromates, or a mixture of such materials in well defined proportions. The use of chromic acid or any other chromium based deoxidizing solutions in the finishing industry creates waste disposal difficulties. Further, the use of chromic acid in certain finishing shops may cause contamination of rinsing waters, bright dips, anodizing, and plating solutions. Further, these conventional methods have been relatively slow in smut removal.

SUMMARY OF THE INVENTION

Therefor, an object of the present invention is to provide a deoxidizing agent which does not contain chromium.

A further object of the present invention is to provide a desmutting agent capable of removing smut at a high rate. According to the present invention, there are provided novel compositions and methods which may be used to desmut or deoxidize aluminum surfaces.

It has been found that the surfaces of aluminum or aluminum alloys can be deoxidized and desmutted by bringing the aluminum surface into contact with an aqueous solution comprising nitric acid and an alkali metal halate, and optionally, an activator. It has been found that the presence of the activator improves the action of the deoxidizing solution to a significant degree, but is not essential to the invention.

DESCRIPTION OF PREFERRED EMBODIMENTS

It has been found that optimum deoxidizing and desmutting may be achieved by the use of an aqueous solution of from about 1 to about 30% nitric acid, and from about 0.01 to about 20% of an alkali metal or ammonium halate oxidizer selected from the group consisting of bromates, iodates, and chlorates, and from about 0–5% to 5% by weight of an activator selected from the group consisting of alkali metal or ammonium vanadates, molybdates and tungstates. The preferred embodiment of such solutions comprises nitric acid, sodium bromate, and ammonium meta vanadate. The nitric acid may preferably be present in a concentration of from about 5 to about 15 percent, and most preferably about 10 percent.

Although various acids have been utilized for deoxidizing and desmutting operations in the past, it has been found in the present invention that nitric acid is the preferred embodiment. Other acids, such as acetic acid, hydrochloric acid, sulfuric acid, and organic acids such as nitrilotris(methylene)triphosphonic acid have been utilized in combination with the bromate oxidant, and have been found to be ineffective for desmutting.

The oxidant of the present invention is an acidic aqueous material containing bromate, iodate, or chlorate, preferably in combination with a soluble activating material. The improved described oxidant is readily made by mixing the halate together with at least one water soluble activator-containing compound, in water. The nitric acid is preferably thereafter admixed with the solution.

The oxidant of the present invention is an alkali metal or ammonium halate selected from the group consisting of bromate, iodate, and chlorate. In order of preference, bromates have been found to be the preferred embodiment, iodates the second most preferred, and chlorates the less preferred of the three halates. The halates suitable for the present invention comprise alkali metal, or ammonium halates. Suitable alkali metals include lithium, sodium, potassium, rubidium, and cesium, with the preferred alkali metals being sodium or potassium.

The selected halate oxidant is used in aqueous solution in concentrations of from about 0.01 to about 20%, preferably from 0.1 to 10%, and most preferably from about 1 to about 5%. It is preferred to employ low concentrations within these ranges in the interest of economy, as offset by the effectiveness and speed of deoxidizing/desmutting. The most effective range and oxidant have been found to be about 3% of sodium bromate.

In accordance with the present invention, a suitable salt selected from vanadate, molybdate, or tungstate may also be employed in the aqueous deoxidizing solution as an activator. It has been found that the most effective activators constitute alkali metal or ammonium vanadates, with the tungstates being less effective, and the molybdates still less effective. The activator salt is preferably employed in smaller amounts than the oxidant, and a concentration in the range of 0.005 to about 5% by weight, preferably from about 0.01 to about 2%, may be employed. The amount of activator may also be based on the amount of oxidant employed if desired, and, if so measured, a suitable weight ratio of oxidant to activator is from 1:1 to 100:1, preferably 1:1 to 25:1. While smaller or larger ratios may be employed, it is generally uneconomical to employ ratios outside these limits. The mechanism or action of the activator salt on the deoxidizing characteristics of the halate solution as it relates to desmutting is presently not known. Whatever the mechanism, the presence of the activator salt in the solution accelerates the oxidative effect of the solution on smut.

The following illustrative examples are not intended to limit the scope of the present invention, but to illustrate its application and use.

EXAMPLE 1

A deoxidizing solution comprising 10% nitric acid, 1% sodium bromate, and 0.01% ammonium meta vanadate was prepared. Coupons of aluminum alloys 6061, 2014, and 2216 were etched in caustic solutions, rinsed, and then immersed in the desmutting solution for 1 minute at room temperature. Comparative coupons of the same alloys were similarly prepared and subjected to commercially available chromate and non-chromate desmutters. Comparison showed that the new chromate-free desmutter of the present invention was notably superior to the chromate desmutter as well as more effective than the two commercially available non-chromate desmutters. Effective desmutting with the commercial products occurred at a 25% concentration level, while a similar effect was attained with a 1% oxidant concentration of the product disclosed herein.

EXAMPLE 2

A desmutting solution was prepared comprising 10% nitric acid, 1% sodium bromate, and 0.01% ammonium meta vanadate. This formulation was compared to a commercially available dichromate deoxidizer, and found to efficiently desmut a 2014 aluminum sample in 3 to 5 seconds, while the dichromate deoxidizer took from 1 to 2 minutes. Up to 80 square feet of test panel were etched for up to 5 minutes and desmutted in one gallon of the formulation of the present invention. Desmut time remained under 5 seconds. The amount of processed surface area required to reduce the active ingredient in the formulation to 50% of its initial concentration was found to be about 400 square feet per gallon of process solution. At this rate, the deoxidizer of the present example has a process bath lifetime projected to be double that of the commercially available dichromate deoxidizer.

An important test of any deoxidizer is the 168 hour salt fog environmental corrosion test, in accordance with Military Specification MIL-C-5541. This test was conducted relative to the present non-chromate deoxidizer, and it was found that the panels deoxidized with the deoxidizer of the present invention exhibited fewer corrosion signs than panels deoxidized in the chromate containing formulation. Accordingly, it would appear that residual corrosion resulting from the deoxidizer of the present invention is decreased as compared to conventional deoxidizers.

EXAMPLE 3

A test solution comprising 10% acetic acid, 3% sodium bromate, and 0.03% ammonium meta vanadate was prepared. A test coupon of aluminum alloy 2219 was etched for 2 minutes, and rinsed. Upon immersion of the coupon into the desmutter solution, bubbles were created, and the solution clouded and turned brown. It was found that the solution did not desmut the coupon.

EXAMPLE 4

A test solution of 10% hydrochloric acid, 3% sodium bromate, and 0.03% ammonium meta vanadate was prepared. A test coupon of aluminum alloy 2219 was etched for two minutes and rinsed. Upon addition of the bromate to the hydrochloric acid and water, a gas evolved. Upon immersion of the 2219 coupon, bubbling was observed and a gas was evolved with the solution becoming cloudy yellow. It was found that the solution did not desmut the coupon.

EXAMPLE 5

A test solution of 10% nitric acid, 3% sodium bromate, and 0.03 sodium molybdate was prepared. A test coupon of aluminum alloy 2219 was etched for 2 minutes and rinsed. Upon immersion of the test coupon in the clear test solution, smut was removed in 45 seconds. The smut particles did not go into solution, and the solution turned yellow.

EXAMPLE 6

A test solution of 10% nitric acid, 3% sodium bromate, and 0.03% sodium tungstate was prepared. A test coupon of aluminum alloy 2219 was etched for 2 minutes and rinsed. Upon immersion of the coupon in the clear test solution smut was removed within 15 seconds.

EXAMPLE 7

A series of test solutions were prepared, comprising of varying amounts of nitric acid with 3% sodium bromate and 0.03% ammonium meta vanadate. Test coupons of aluminum alloy 2219 were etched for 2 minutes and rinsed. When the test coupons were immersed in the test solution the following results were obtained: with 1% nitric acid, the smut was removed in 16 seconds, but all of the vanadate did not fully dissolve; with 5% nitric acid, the smut was removed in 11 seconds, and the vanadate was fully dissolved; with 20% nitric acid, the smut was removed in 1.5 seconds; and with 30% nitric acid, the smut was removed in 0.8 seconds.

EXAMPLE 8

A test solution of 10% sulfuric acid, 3% sodium bromate, and 0.03% ammonium meta vanadate was prepared. A test coupon of aluminum alloy 2219 was etched for 2 minutes and rinsed. Upon immersion of the test coupon in the yellow solution, the piece reacted and a gas was evolved. Smut was not removed.

EXAMPLE 9

A test solution of 10% nitric acid, 10% sodium bromate, and 0.1% ammonium meta vanadate was prepared. A test coupon of aluminum alloy 2219 was etched for 2 minutes, and rinsed. Upon immersion of the test coupon in the yellow test solution, smut was removed in 10 seconds, and completely dissolved.

EXAMPLE 10

A test solution of 10% nitric acid, 0.1% sodium bromate and 0.001% ammonium meta vanadate was prepared. A test coupon of aluminum alloy 2219 was etched for 2 minutes, and rinsed. Upon immersion of the test coupon in the pale yellow test solution, smut was removed in one hour, and fully dissolved.

EXAMPLE 11

A test solution of 10% nitrilotris(methylene)triphosphonic acid, 3% sodium bromate, and 0.03% ammonium meta vanadate was prepared. A test coupon of aluminum alloy 2219 was etched for 2 minutes, and rinsed. When the test solution was prepared it was a light blue color. Upon immersion of the test coupon in the solution, the solution turned green. No smut was removed by the solution, although the smut did wipe off easily when the coupon was dried.

EXAMPLE 12

A solution of 10% nitric acid and 3% sodium bromate was prepared. No activator was added. A test coupon of aluminum alloy 2219 was etched for 2 minutes, and rinsed. When the test coupon was immersed, smut was removed in 30 seconds. The solution turned yellow.

EXAMPLE 13

A test solution of 10% nitric acid, 3% sodium iodate, and 0.03% ammonium meta vanadate was prepared. A test coupon of aluminum alloy 2219 was etched for 2 minutes and rinsed. Upon immersion of the test coupon in the clear iodate solution, smut was removed in 2 seconds, with the solution turning orange.

EXAMPLE 14

A test solution of 10% nitric acid and 3% sodium iodate was prepared. No activator was added. A test coupon of aluminum alloy 2219 was etched for 2 minutes, and rinsed. Upon immersion of the test coupon in the clear iodate solution, smut was removed in about 15 seconds. The color of the solution turned yellow-orange.

As previously indicated, the deoxidizing solution of the present invention is suitable for aluminum and aluminum alloys in which smut formation or surface oxide contamination may be problems, particularly those which are to be further treated such as by painting, anodizing, plating, bright dipping, welding, chromating, etc. Because of the very dilute concentrations of active components of the deoxidizing solution necessary, and the very high solubility of the reaction products of the deoxidizing treatment, rinsing of the desmutted aluminum is relatively simple and effective in removal of the deoxidizing solution.

Processing time, of course, depends upon the degree of oxidation of the metal surface, the extent of smut contamination, the concentration of the active agents in solution, and the temperature. There is relatively little advantage to heating the deoxidizer solution, however, in view of the rapid action at room temperature and the added cost and difficulty of heating and handling heated nitric acid solutions.

It is understood that the above description of the present invention is susceptible to considerable modification, change, and adaptation by those skilled in the art, and such modifications, changes, and adaptations are intended to be written the scope of the present invention, which is set forth by the following claims.

What is claimed is:

1. A deoxidizing solution for aluminum alloys which consists essentially of an aqueous solution of nitric acid, and an alkali metal or ammonium halate salt.

2. The solution of claim 1, wherein the halate salt is selected from the chlorates, iodates, or bromates of lithium, sodium, potassium, rubidium, cesium, and ammonium.

3. The solution of claim 2, wherein the halate salt is present in a concentration of from about 0.01 to about 20 percent by weight.

4. The solution of claim 2, wherein the halate salt is present in a concentration of from about 0.01 to about 10 percent by weight.

5. The solution of claim 2, wherein the halate salt is present in a concentration of from about 1 to about 5 percent by weight.

6. The solution of claim 2, wherein the nitric acid is present in a concentration of from about 1 to about 30 percent by weight.

7. The solution of claim 2, wherein the nitric acid is present in a concentration of from about 5 to about 15 percent by weight.

8. The solution of claim 7, wherein the halate salt is selected from the group consisting of sodium bromate and potassium bromate.

9. The solution of claim 8, wherein said halate salt is present in a concentration of from about 0.01 to about 10 percent by weight.

10. The solution of claim 8, wherein said halate salt is present in a concentration of from about 1 to about 5 percent by weight.

11. The solution of claim 2, wherein said nitric acid is present in a concentration of about 10 percent by weight.

12. The solution of claim 11, wherein the halate salt is selected from the group consisting of sodium bromate and potassium bromate.

13. The solution of claim 12, wherein said halate salt is present in a concentration of from about 0.01 to about 10 percent by weight.

14. The solution of claim 12, wherein said halate salt is present in a concentration of from about 1 to about 5 percent by weight.

15. The solution of claim 1, compromising about 10 percent nitric acid and from about 1 to about 5 percent by weight sodium bromate.

16. A deoxidizing solution for aluminum alloys, consisting essentially of water, nitric acid, an alkali metal halate salt, and an activator.

17. The solution of claim 16, wherein said halate is selected from the group consisting of halates of lithium, sodium, potassium, rubidium, and cesium.

18. The solution of claim 17, wherein said activator is selected from the group consisting of alkali metal, and ammonium vanadates, molybdates, and tungstates.

19. The solution of claim 18, wherein said nitric acid is present in a concentration of from about 1 to about 30 percent by weight.

20. The solution of claim 19, wherein said alkali metal halate is present in a concentration of from about 0.01 to about 20 percent by weight.

21. The solution of claim 20, wherein said activator is present in a concentration of from about 0.005 to about 5 percent by weight.

22. The solution of claim 20, wherein said activator is present in a concentration of from about 0.01 to about 2 percent by weight.

23. The solution of claim 19, wherein said halate is present in a concentration of from about 0.01 to about 10 percent by weight.

24. The solution of claim 23, wherein said activator is present in a concentration of from about 0.005 to about 5 percent by weight.

25. The solution of claim 23, wherein said activator is present in a concentration of from about 0.01 to about 2 percent by weight.

26. The solution of claim 19, wherein said halate salt is present in a concentration of from about 1 to about 5 percent by weight.

27. The solution of claim 26, wherein said activator is present in a concentration of from about 0.005 to about 5 percent by weight.

28. The solution of claim 26, wherein said activator is present in a concentration of from about 0.01 to about 2 percent by weight.

29. The solution of claim 18, wherein said nitric acid is present in a concentration of from about 5 to about 15 percent by weight.

30. The solution of claim 20, wherein said halate is present in a concentration of from about 0.01 to about 20 percent by weight.

31. The solution of claim 30, wherein said activator is present in a concentration of from about 0.005 to about 5 percent by weight.

32. The solution of claim 30, wherein said halate is present in a concentration of from about 0.01 to about 10 percent by weight.

33. The solution of claim 29, wherein said halate is present in a concentration of from about 0.01 to about 10 percent by weight.

34. The solution of claim 33, wherein said activator is present in a concentration of from about 0.005 to about 5 percent by weight.

35. The solution of claim 33, wherein said activator is present in a concentration of from about 0.01 to about 2 percent by weight.

36. The solution of claim 29, wherein said halate salt is present in a concentration of from about 1 to about 5 percent by weight.

37. The solution of claim 26, wherein said activator is present in a concentration of from about 0.005 to about 5 percent by weight.

38. The solution of claim 26, wherein said activator is present in a concentration of from about 0.01 to about 2 percent by weight.

39. The solution of claim 18, wherein the nitric acid is present in a concentration of about 10 percent by weight.

40. The solution of claim 39, wherein said halate is present in a concentration of from about 1 to about 5 percent by weight.

41. The solution of claim 40, wherein said activator is present in a concentration of from about 0.01 to about 2 percent by weight.

42. The solution of claim 41 wherein said halate is sodium bromate.

43. The solution of claim 42 wherein said activator is ammonium meta vanadate.

44. The solution of claim 43 wherein the ratio of said halate to said activator is from about 1:1 to about 100:1.

45. A process for deoxidizing and desmutting aluminum and aluminum alloy articles which comprises immersing such articles in an aqueous solution consisting essentially of nitric acid and a halate salt selected from the group consisting of alkali metal bromates, chromates, an iodates, for a period of at least 1 second.

46. The process of claim 45 wherein said solution comprises from about 1 to about 30 percent by weight nitric acid and from about 0.01 to about 20 percent by weight halat salt.

47. The process of claim 46 wherein said halate salt is sodium bromate.

48. The process of claim 45 wherein said solution comprises from about 5 to about 15 percent by weight nitric acid and from about 0.01 to about 10 percent by weight halate salt.

49. The process of claim 48 wherein said halate salt is sodium bromate.

50. The process of claim 45 wherein said solution comprises about 10 percent by weight nitric acid and from about 1 to about 5 percent by weight halate salt.

51. The process of claim 50 wherein said halate salt is sodium bromate.

52. The process of claim 45 wherein said solution further comprises from about 0.005 to about 5 percent by weight of an activator selected from the group consisting of alkali metal or ammonium vanadates, molybdates, and tungstates.

53. The process of claim 52 wherein said solution comprises about 10 percent by weight nitric acid and from about 1 to about 5 percent by weight halate salt.

54. The process of claim 53 wherein said activator comprises from about 0.01% to about 2 percent by weight of said solution.

55. The process of claim 54 wherein said activator comprises ammonium meta vanadate and said halate salt is sodium bromate.

* * * * *